US009755374B2

(12) United States Patent
St. Laurent et al.

(10) Patent No.: US 9,755,374 B2
(45) Date of Patent: Sep. 5, 2017

(54) WALL SOCKET PLATES AND SIGNAL BOOSTERS AND SYSTEMS AND METHODS THEREOF

(71) Applicant: SNAPRAYS, LLC, Vineyard, UT (US)

(72) Inventors: Daniel St. Laurent, Webster, MA (US); Daniel Diotte, Pickering (CA); William Olszta, Webster, MA (US)

(73) Assignee: SnapRays, LLC, Vineyard, UT (US)

( * ) Notice: Subject to any disclaimer, the term of this patent is extended or adjusted under 35 U.S.C. 154(b) by 0 days.

(21) Appl. No.: 15/281,191

(22) Filed: Sep. 30, 2016

(65) Prior Publication Data

US 2017/0018890 A1 Jan. 19, 2017

Related U.S. Application Data

(63) Continuation-in-part of application No. 13/821,366, filed as application No. PCT/US2011/050524 on Sep. 6, 2011, now Pat. No. 9,482,426.

(60) Provisional application No. 61/380,561, filed on Sep. 7, 2010.

(51) Int. Cl.

| | |
|---|---|
| ***H05B 37/00*** | (2006.01) |
| ***H01R 13/717*** | (2006.01) |
| ***H01R 24/76*** | (2011.01) |
| ***H01R 25/00*** | (2006.01) |
| *H01R 103/00* | (2006.01) |

(52) U.S. Cl.

CPC ..... *H01R 13/7175* (2013.01); *H01R 24/76* (2013.01); *H01R 25/006* (2013.01); *H01R 2103/00* (2013.01)

(58) Field of Classification Search

None

See application file for complete search history.

(56) References Cited

U.S. PATENT DOCUMENTS

| | | | |
|---|---|---|---|
| 2,015,698 | A | 10/1935 | Tiffany |
| 2,227,549 | A | 1/1941 | McNeill |
| 2,385,620 | A | 9/1945 | Fleckenstein |
| 2,428,167 | A | 9/1947 | Linton |
| 2,515,820 | A | 7/1950 | Clark |
| 2,575,820 | A | 11/1951 | Linton |
| 2,580,056 | A | 12/1951 | Wheeler, Jr. |
| 2,749,381 | A | 6/1956 | Farish |
| 2,880,285 | A | 3/1959 | Robison et al. |
| 2,908,743 | A | 10/1959 | Premoshis |
| 2,934,590 | A | 4/1960 | Thompson, et al. |

(Continued)

FOREIGN PATENT DOCUMENTS

| | | |
|---|---|---|
| EP | 2211210 | 3/2007 |
| WO | 2007122141 | 11/2007 |
| WO | 2012006812 | 1/2012 |

OTHER PUBLICATIONS

Plate Pals Wallplate Thermometers, http://www.platepals.com/ last visited Apr. 21, 2017, 2006.

*Primary Examiner* — Cassandra Cox

(57) ABSTRACT

The invention relates generally to a wall socket plate for replacing existing wall sockets in one simple installation step. The wall socket plate obtains electric current from socket terminal screws to power a signal booster fluidly coupled to a wall socket plate. The signal booster is powered by transferring electric current from the socket terminal screws through conductive material to the signal booster, in accordance with the invention described herein.

8 Claims, 4 Drawing Sheets

(56) References Cited

U.S. PATENT DOCUMENTS

| | | | |
|---|---|---|---|
| 3,120,414 | A | 2/1964 | Farish, Jr. |
| 3,307,030 | A | 2/1967 | Francisco |
| D212,760 | S | 11/1968 | Bordner |
| 3,522,595 | A | 8/1970 | White |
| 3,588,489 | A | 6/1971 | Gaines |
| 3,680,237 | A | 8/1972 | Finnerty, Sr. |
| 3,739,226 | A | 6/1973 | Seiter et al. |
| D230,274 | S | 2/1974 | Palos |
| 3,859,454 | A | 1/1975 | Mann |
| 3,879,101 | A | 4/1975 | McKissic |
| 4,000,405 | A | 12/1976 | Horwinski |
| 4,038,582 | A | 7/1977 | Horwinski |
| 4,117,258 | A | 9/1978 | Shanker |
| 4,255,780 | A | 3/1981 | Sakellaris |
| 4,282,591 | A | 8/1981 | Andreuccetti |
| 4,514,789 | A | 4/1985 | Jester |
| 4,534,486 | A | 8/1985 | Eidson |
| 4,611,264 | A | 9/1986 | Bradley |
| 4,616,285 | A | 10/1986 | Sackett |
| 4,617,613 | A | 10/1986 | Rice |
| 4,755,913 | A | 7/1988 | Sleveland |
| 4,774,641 | A | 9/1988 | Rice |
| D330,267 | S | 10/1992 | Hendrix |
| 5,248,919 | A | 9/1993 | Hanna |
| 5,290,175 | A | 3/1994 | Robinson |
| 5,384,428 | A | 1/1995 | Luu |
| 5,406,439 | A | 4/1995 | Crane et al. |
| 5,473,517 | A | 12/1995 | Blackman |
| D366,339 | S | 1/1996 | Waller |
| 5,481,442 | A | 1/1996 | Dickie et al. |
| 5,485,356 | A | 1/1996 | Nguyen |
| 5,622,424 | A | 4/1997 | Brady |
| 5,670,776 | A | 9/1997 | Rothbaum |
| 5,683,166 | A | 11/1997 | Lutzker |
| D395,314 | S | 6/1998 | Oikawa |
| D399,825 | S | 10/1998 | Heung et al. |
| 5,816,682 | A | 10/1998 | Marischen |
| D401,566 | S | 11/1998 | Gesmondi |
| D407,072 | S | 3/1999 | Gaule |
| 5,914,826 | A | 6/1999 | Smallwood |
| 6,000,807 | A | 12/1999 | Moreland |
| 6,010,228 | A | 1/2000 | Blackman |
| 6,023,021 | A | 2/2000 | Matthews et al. |
| 6,087,588 | A | 7/2000 | Soules |
| 6,089,893 | A | 7/2000 | Yu et al. |
| D429,829 | S | 8/2000 | Doran |
| D464,865 | S | 10/2002 | Luu |
| D473,528 | S | 4/2003 | Wengrower |
| 6,547,411 | B1 | 4/2003 | Dornbusch |
| 6,765,149 | B1 | 7/2004 | Ku |
| D500,743 | S | 1/2005 | Savicki, Jr. et al. |
| 6,974,910 | B2 | 12/2005 | Rohmer |
| 7,011,422 | B2 | 3/2006 | Robertson et al. |
| 7,036,948 | B1 | 5/2006 | Wyatt |
| D542,627 | S | 5/2007 | Rohmer et al. |
| 7,247,793 | B2 | 7/2007 | Hinkson |
| 7,270,436 | B2 | 9/2007 | Jasper |
| 7,318,653 | B2 | 1/2008 | Chien |
| D567,633 | S | 4/2008 | Anderson |
| 7,360,912 | B1 | 4/2008 | Savicki, Jr. |
| D576,566 | S | 9/2008 | Wu et al. |
| D577,985 | S | 10/2008 | Kidman |
| 7,506,990 | B2 | 3/2009 | Glazner |
| 7,547,131 | B2 | 6/2009 | Faunce et al. |
| 7,576,285 | B1 | 8/2009 | Savicki, Jr. |
| D606,029 | S | 12/2009 | Chou |
| 7,745,750 | B2 | 6/2010 | Hewson et al. |
| 7,821,160 | B1 | 10/2010 | Roosli et al. |
| 7,946,871 | B1 | 5/2011 | Yu et al. |
| 8,003,886 | B1 | 8/2011 | Rintz |
| D650,112 | S | 12/2011 | Bryant |
| 8,148,637 | B2 | 4/2012 | Davidson |
| 8,304,652 | B2 | 11/2012 | McBain |
| 8,393,747 | B2 | 3/2013 | Kevelos et al. |
| 8,511,866 | B1 | 8/2013 | Mendez |
| 8,564,279 | B2 | 10/2013 | Johnson et al. |
| 8,668,347 | B2 | 3/2014 | Ebeling |
| 8,697,991 | B2 | 4/2014 | Davidson |
| 8,797,723 | B2 * | 8/2014 | Hilton et al. ..... H02J 13/0003 700/295 |
| D719,699 | S | 12/2014 | Bryant |
| 8,912,442 | B2 * | 12/2014 | Smith ..... H01R 13/60 439/131 |
| 9,482,426 | B2 | 11/2016 | Diotte |
| 2001/0046130 | A1 | 11/2001 | Cunningham et al. |
| 2003/0013503 | A1 | 1/2003 | Menard et al. |
| 2003/0124022 | A1 | 7/2003 | Georges et al. |
| 2004/0247300 | A1 | 12/2004 | He et al. |
| 2005/0264383 | A1 | 12/2005 | Zhang |
| 2006/0065510 | A1 | 3/2006 | Kiko et al. |
| 2006/0072302 | A1 | 4/2006 | Chien |
| 2006/0161270 | A1 | 7/2006 | Luskin et al. |
| 2006/0262462 | A1 | 11/2006 | Barton |
| 2007/0206375 | A1 * | 9/2007 | Piepgras et al. ..... H01R 9/2416 200/200 |
| 2008/0073117 | A1 | 3/2008 | Misener |
| 2008/0266121 | A1 | 10/2008 | Ellul |
| 2009/0153438 | A1 | 6/2009 | Miller et al. |
| 2009/0225480 | A1 | 9/2009 | Baxter |
| 2009/0284385 | A1 | 11/2009 | Tang et al. |
| 2011/0056720 | A1 | 3/2011 | Davidson |
| 2011/0082599 | A1 * | 4/2011 | Shinde et al. ..... A43B 1/0027 362/147 |
| 2011/0210833 | A1 | 9/2011 | McNeely et al. |
| 2012/0008307 | A1 | 1/2012 | Delany |
| 2012/0156937 | A1 | 6/2012 | Almouli |
| 2012/0182172 | A1 | 7/2012 | Sorensen |
| 2012/0215470 | A1 | 8/2012 | Maguire |
| 2012/0316808 | A1 | 12/2012 | Frader-Thompson et al. |
| 2013/0063848 | A1 | 3/2013 | Thorpe et al. |
| 2013/0221868 | A1 | 8/2013 | Diotte et al. |
| 2015/0371534 | A1 | 12/2015 | Dimberg et al. |

* cited by examiner

WALL SOCKET PLATES AND SIGNAL BOOSTERS AND SYSTEMS AND METHODS THEREOF

CROSS-REFERENCE TO RELATED APPLICATIONS

This application claims priority to U.S. provisional application No. 61/380,561 filed Sep. 7, 2010, PCT application No. PCT/US2011/050524 filed Sep. 6, 2011, and U.S. utility application Ser. No. 13/821,366, filed Mar. 7, 2013 and incorporates the entire contents thereof herein by reference.

FIELD OF THE INVENTION

The invention relates generally to an easy to install wall socket plate with a signal booster embedded or fluidly coupled to the wall socket plate, wherein power to the signal booster is obtained from wall socket terminals, to power the signal booster while still maintaining the socket receptacles open for use.

BACKGROUND INFORMATION

The invention relates generally to an advanced wall socket plate with a signal booster connected to the wall socket plate that can be installed easily to replace existing wall socket receptacles with sockets capable of relaying signal connection and boosting signal signals. The wall socket plate in accordance with the present invention has metal tabs and conductive material on the back of the plate to obtain electric current from the terminal screws and supply electric current to an embedded signal booster for providing strong signaled internet connections throughout a desired location.

Various wall socket plates with additional features have been devised and constructed to enhance or add to the standard wall socket plate. Examples of enhanced wall socket plates include U.S. Pat. No. 7,318,653 which covers a multiple function wall cover plate with a front cover and a bottom base, prongs to supply electricity from an existing receptacle, a light between the front cover and the back base and a fragrance refill means. The multiple function wall cover plate uses one prong set to plug into an existing wall socket receptacle to power one or more new receptacles on the multiple function wall cover plate and to power the added features of the multiple function wall cover plate. Unlike the present invention, the '653 patent requires the use of existing receptacles to power the multiple function wall cover plate and requires a bulky system to provide new receptacles in order to maintain the original number of receptacles in the wall socket.

Other U.S. references found include U.S. Pat. Nos. 2,015,698; 3,307,030; 3,895,225; 4,774,641; 5,683,166; 6,089,893; 6,709,126; 6,648,496. None of the prior references discovered describe or show the ability to power at least a third receptacle without blocking one socket receptacle or using the prongs of one socket receptacle to power a power strip or other multiple receptacle object. The ability to use electric current in wall socket terminals to power a signal booster embedded in the wall socket plate is a unique discovery in accordance with the present invention.

SUMMARY

A wall socket plate in accordance with the present invention provides an easy method for replacing standard wall socket plates with an improvement of having a signal booster embedded in the wall socket plate and powered by the terminal screws, while still maintaining both receptacles on the wall socket open for use. The wall socket plate utilizes a simple technique where metal tabs are used to conduct power in the existing wall socket terminal screws to convert and provide electric current to power a signal booster embedded in the wall socket plate. In accordance with at least one of the methods and devices described herein, the signal booster embedded in the wall socket plate relays signal router signals and repeats those signals, thereby enhancing the signal range in a convenient mechanism for the user, for instance, for a more robust network or cellular phone connection points.

There are many uses for a wall socket plate with a signal booster embedded therein, as further described herein.

BRIEF DESCRIPTION OF DRAWINGS

These objectives and features of the invention shall now be described in relationship to the following figures, which are an integral part of the specifications and are incorporated herein.

DETAILED DESCRIPTION OF THE PREFERRED EMBODIMENT

In the following detailed description of the invention, reference is made to the accompanying drawings, which form a part hereof, and which is shown by way of illustration of specific exemplary embodiments in which the invention may be practiced. These embodiments are described in sufficient detail to enable those skilled in the art to practice the invention, but other embodiments may be utilized and logical and other changes may be made without departing from the scope of the present invention. The following detailed description is, therefore, not to be taken in a limiting sense.

In the following description, numerous specific details are set forth to provide a thorough understanding of the invention. However, it is understood that the invention may be practiced without these specific details. In other instances, well-known steps, tools and techniques and socket types known to one of ordinary skill in the art have not been shown in detail in order not to obscure the invention. Referring to the figures, it is possible to see the various major elements constituting the methods and systems of the present invention.

Figure 1:
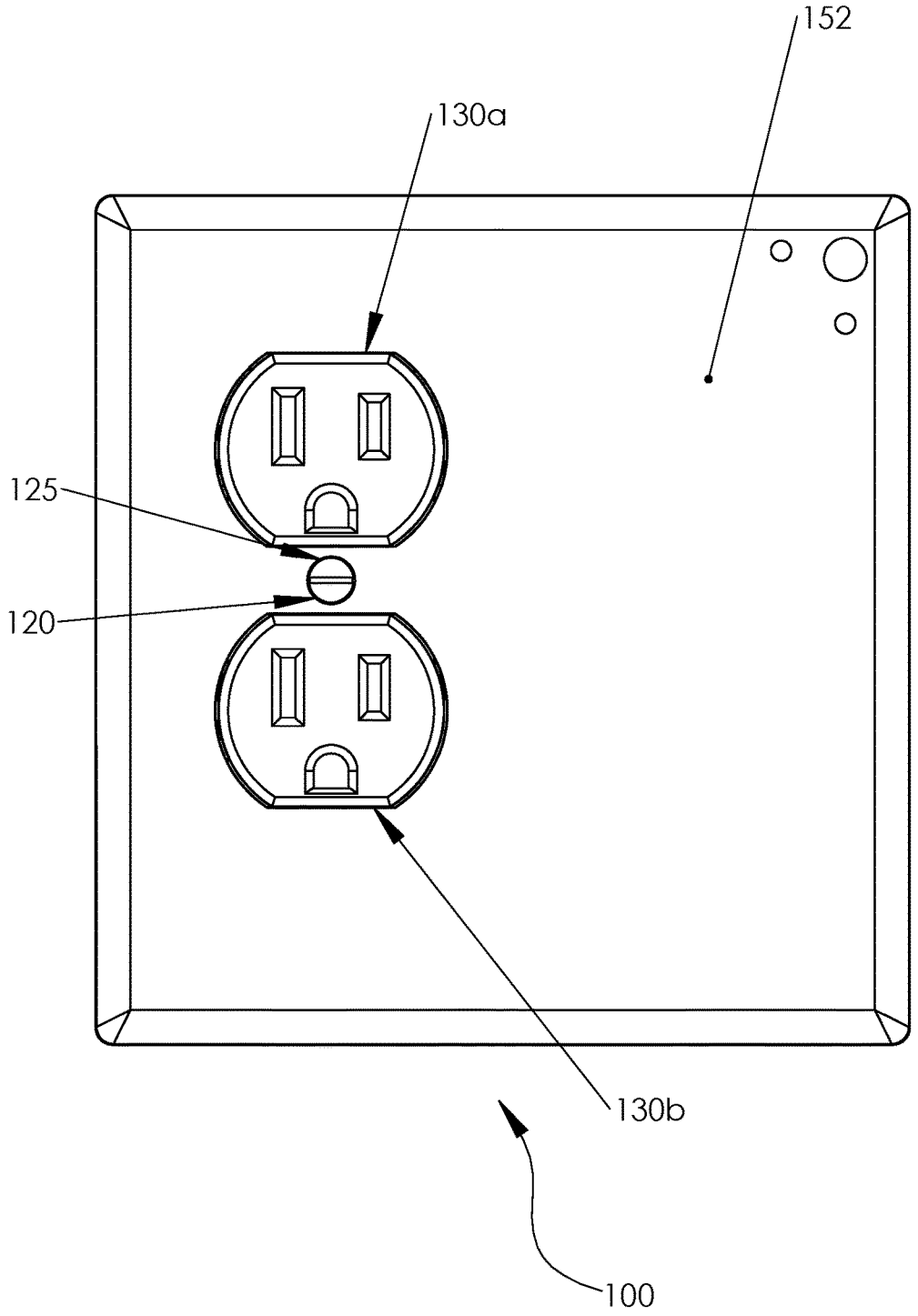
FIG. 1 is a front view of the wall socket plate in accordance with an embodiment of the present invention.

As shown in the drawings wherein like numerals represent like parts throughout the several views, there is generally disclosed in FIG. 1 a front view of a wall socket plate 100, a first receptacle 130*a*, a second receptacle 130*b*, as found in standard wall socket plates, a hole for a screw 120 for attaching the wall socket plate 100 to a wall with a screw 125, and a signal booster 152 embedded or fluidly connected to the wall socket plate 100. In accordance with the embodiment shown, the wall socket plate 100 can easily replace a standard socket plate by simply removing the socket plate and screwing in the wall socket plate 100, and the embedded signal booster will be powered for relaying and boosting a signal, thereby allowing a user to have increased signal power, save money on purchasing multiple signal devices, while still maintaining each of the wall socket receptacles for use without having to block one receptacle with, for instance, in order to power the signal booster.

Figure 2:
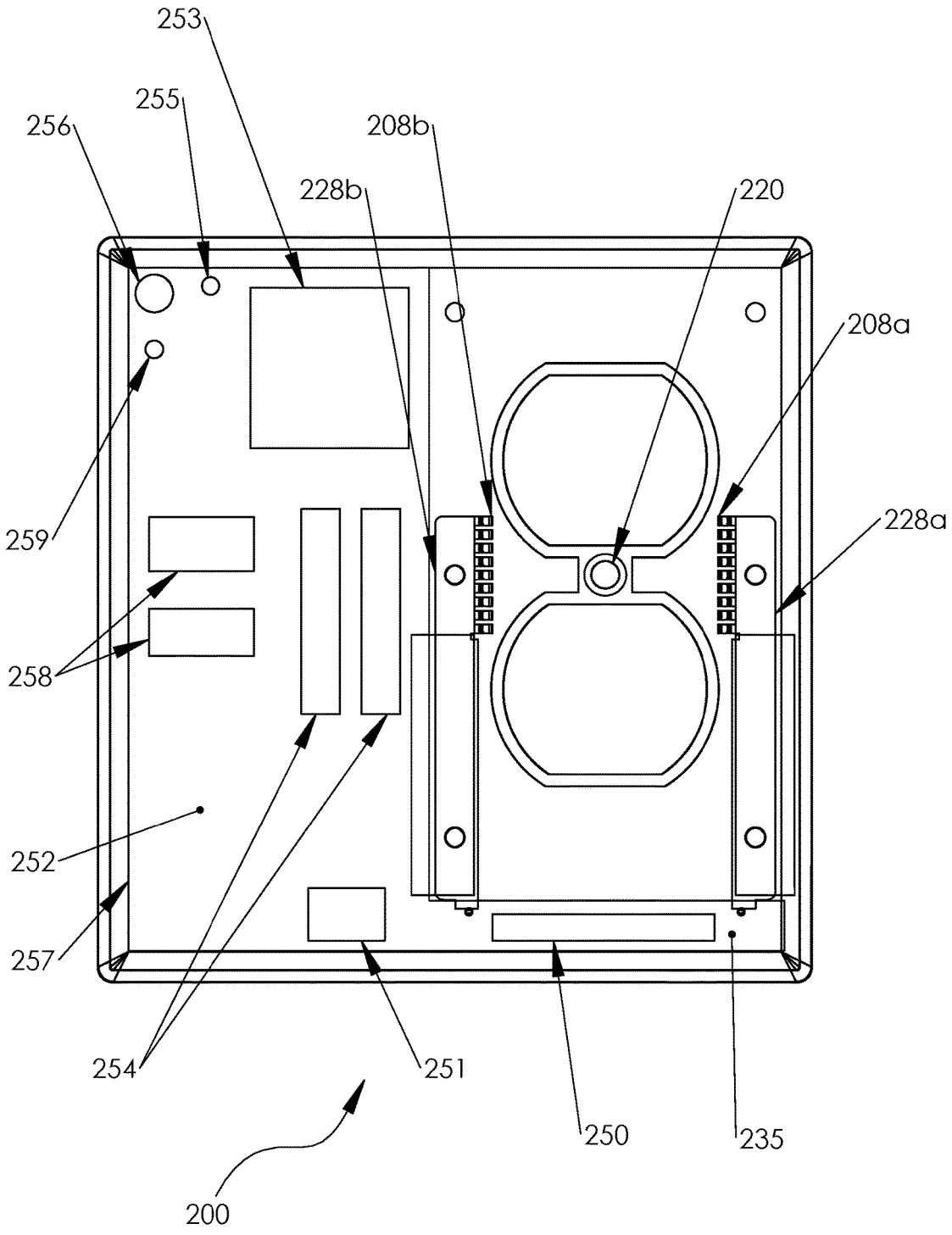
FIG. 2 is a back view of a wall socket plate in accordance with an embodiment of the present invention.

FIG. 2 depicts a back view of the wall socket plate 200 in accordance with the first embodiment of the present invention. The back perspective view shows metal tabs 208*a* and 208*b* for attaching the wall socket plate around existing terminal screws in the wall socket (shown in FIG. 3) for transporting electric current from the terminal screws through the conductive material 228*a* and 228*b* leading the electric current to the signal booster 252 in accordance with the present invention. The metal tabs 208*a* and 208*b* are designed in this embodiment to easily clip around the terminal screws in the wall socket, for easy and safe installation by a user. A hole for a screw 220 is shown in FIG. 2 centered in the plate 200 for attaching the plate 200 to the wall socket with a screw. The conductive material 228*a* and 228*b* carries electric current from the socket terminal screws 208*a* and 208*b* to a circuit board 235 for converting power from high power to low power in order to power the signal booster 252. In this embodiment, the circuit board 235 is formed with a capacitor and resistors to lower the voltage from alternating current to direct current power, or to convert form high alternating current power of about 240 volts to 120 volts to low alternating current power, in a range of about 1 to 5 volts for powering a signal booster 252. In other embodiments rectifiers are used to convert high power current to low power current to power a signal booster 252.

In accordance with the embodiment shown in FIG. 2 the signal booster has a power supply 251 that is connected to the conductive material 228*a* and 228*b* for powering the signal booster 252 from the terminal screws 208*a* and 208*b* in the wall socket plate 200. In accordance with this embodiment the signal booster 252 has several component parts, such as but not including the wireless chip 253, 1 to 3 wireless antenna 254, an LED light 255, a WPS button 256, a PCB board 257, 1 to 2 wireless internet radio 258 and a reset button 259 on the signal booster 252 are all powered by electric current from the terminal screws 208*a* and 208*b*, as further described and shown.

As a further description of the first embodiment in accordance with the present invention, the metal tabs 208*a* and 208*b* are provided to obtain power surrounding the screws in the wall socket, as further shown in FIG. 2. The diameter of the wall socket plate with the metal tabs 208*a* and 208*b* is preferably between 0.01 and 0.07 mm for ease of use by a consumer to replace an already existing wall plate. Non-conductive surrounding material may be used as a safety precaution to surround the metal tabs 208*a* and 208*b*.

In accordance with the back perspective view of the embodiment shown in FIG. 2, a circuit board 235 may be provided in the wall socket plate or in the signal booster 252 to convert power obtained from the wall socket screws to convert power from high power to low power to power the signal booster 252. In accordance with this embodiment, a light may also be powered by electric current obtained from the terminal screws 208*a* and 208 and converted from high power to low power, the light can be any kind of light suitable for a wall socket plate, including but not limited too, E.L elements, light emitting diodes, incandescent bulbs, neon lights, florescent tubes, black lights, gas filled bulbs, halogen lights, or any other light capable of fitting into or connecting to the wall socket plate 200. In addition, the light may be located anywhere on the back or front of the wall socket plate 200 in addition to on or surrounding the signal booster 252.

Figure 3A:
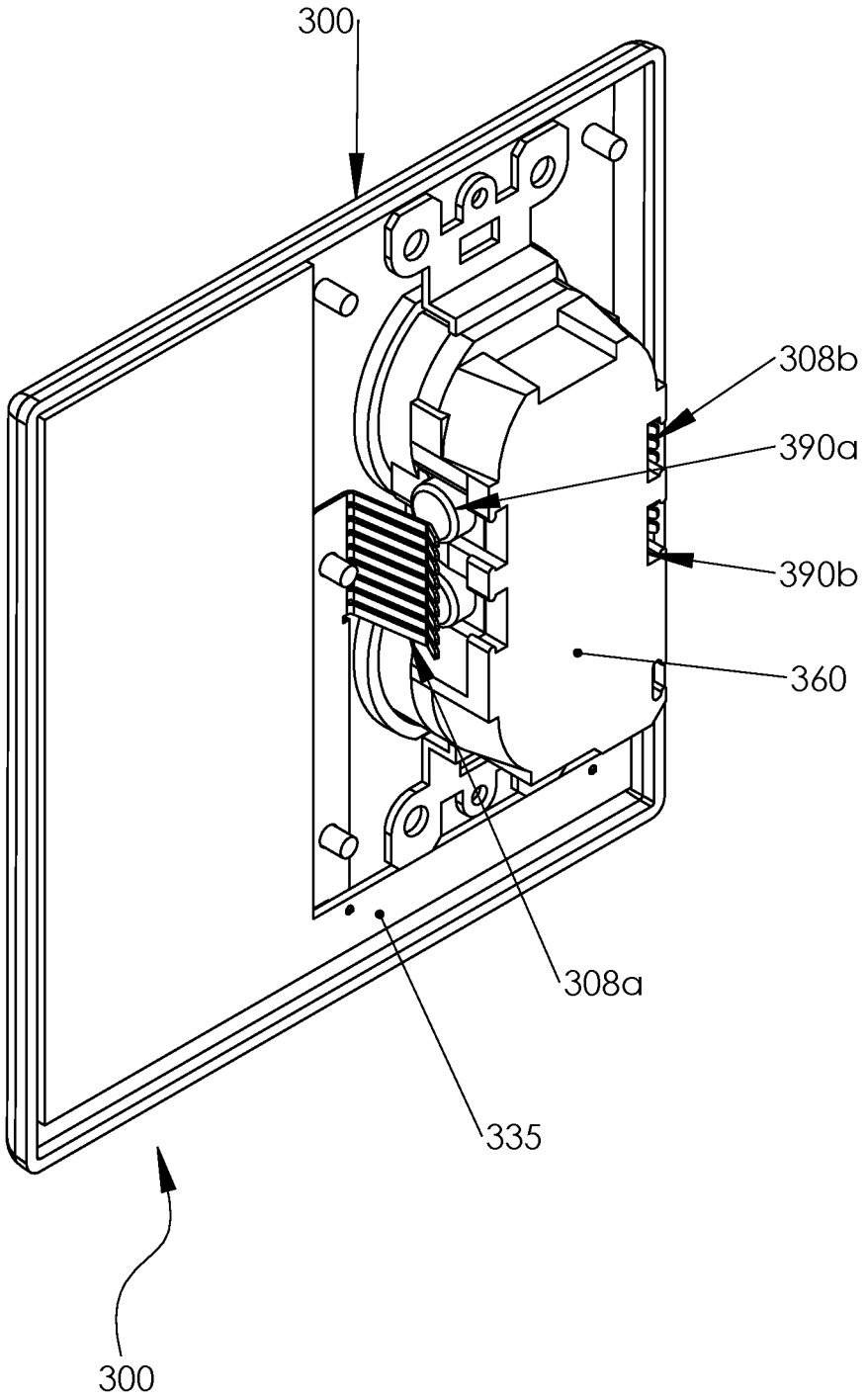
FIG. 3A and FIG. 3B are side perspective views of a wall socket plate and a wall socket showing the metal tabs and the socket terminal screws for supplying electric current to power a signal booster in the wall socket plate in accordance with an embodiment of the present invention.
Figure 3B:
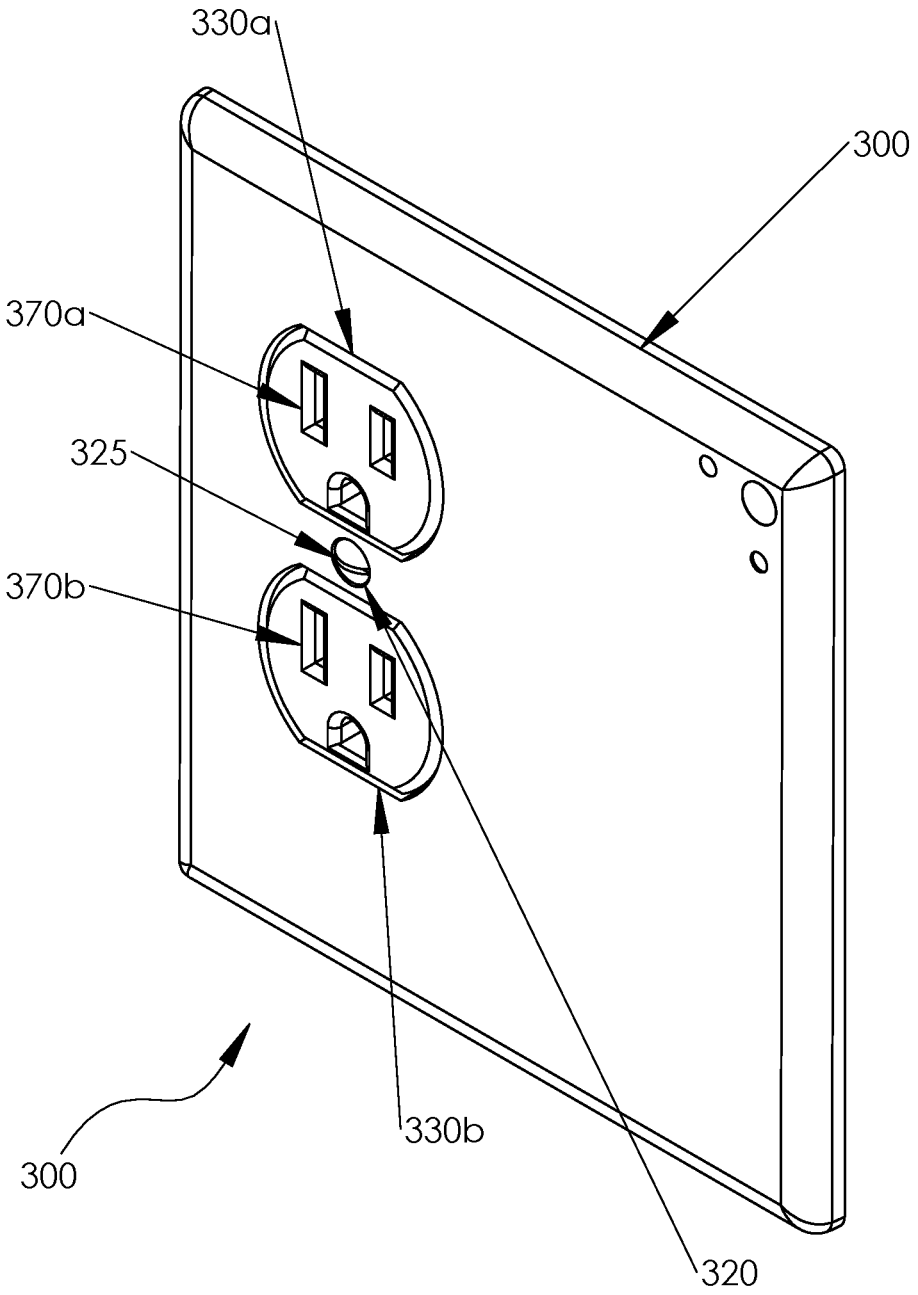

FIGS. 3A and 3B show side perspective views of the wall socket plate 300 being attached to an existing wall socket 360 in accordance with an embodiment of the present invention. In accordance with the embodiment shown, the metal tabs 308*a* and 308*b* are formed to surround the terminal screws 390*a* and 390*b*. A first plate receptacle 330*a* and a second plate receptacle 330*b* are fitted to surround a first wall receptacle 370*a* and a second wall receptacle 370*b* respectively, when the plate 300 is screwed into the wall socket 360, wherein the signal booster 352 is powered when the wall socket plate 300 is screwed into the wall socket 360. A hole for a screw 320 in the plate 300 is further provided to align the screw 325 in the wall socket 360 to affix the wall socket plate 300 to the wall socket 360. FIGS. 3A and 3B shows a signal booster fluidly connected to the wall socket plate 300 and powered by electric current obtained from the terminal screws 308*a* and 308*b*. In accordance with this embodiment the signal booster is powered by converting high power to low power in the circuit board 335.

In accordance with an embodiment of the present invention, three simple steps are provided for affixing the wall socket plate 300 to the wall socket 360. In a first step, a user unscrews an existing socket plate from a wall socket 360. In a second step, a user places the metal tabs 308*a* and 308*b* on the new socket plate to surround terminal screws 390*a*, 390*b*, and in a final step a user places a screw 325 through a hole for a screw 320 in the wall socket plate 300 to attach the wall socket plate 300 to a wall socket. In accordance with the steps described in this embodiment, the signal booster 352 is automatically powered when the wall socket plate 300 is screwed into the wall socket 360, and electric current is carried from the metal tabs 308*a* and 308*b* to power the signal booster 352. In this embodiment, the circuit board 335 is formed with a capacitor and resistors to lower the voltage from alternating current to direct current power, or to convert form high alternating current power of about 240 volts to 120 volts to low alternating current power, in a range of about 1 to 5 volts for powering a light emitting diode light. In other embodiments rectifiers are used convert high power current to low power current to power a signal booster 352 in the wall socket plate 300.

There are many additional features and safety features that can be added to the wall socket plates with at least a third receptacle described in accordance with the embodiments of the present invention shown. Those features include but are not limited too, the addition of rubber or other non-conductive gripping pieces to the wall socket plate or to the metal tabs for ease of installation by a user, shortage safeguards in the circuit board to prevent any possibility of shock to a user, providing an on/off switch for ease of use by a user, along with many other features that a user may desire for safety or aesthetic purposes. In yet other embodiments, sensors may be embedded in the wall socket plate so that a light turns on and off when a signal is given, such as when a user walks by the sensors. In yet other embodiments, fragrance features, decorations, colored lights and/or decorated lights that release patterns, removable lights or light decoration patterns, designs, characters or the like, air fresheners, sound recordings, such as music for a child's room, may be further desired aspects of the present invention as features to add to wall socket plate in accordance with the present invention. For instance, in one embodiment of the present invention an improved wall socket plate with a chamber containing a fragrance is further described, wherein the chamber containing the fragrance is connected to the one or more tabs in accordance with the present invention by a conductive material and wherein the chamber releases the liquid fragrance when the chamber is heated, thereby providing an air freshener to any room from a wall socket plate, without covering any of the existing wall socket receptacles.

In yet another embodiment of the present invention, a method is disclosed for powering a signal booster fluidly coupled to a wall socket plate, comprising the steps of: powering at least a third receptacle on a socket plate, comprising: providing metal tabs on a socket plate for connecting to one or more socket terminal screws; connecting the metal tabs to the socket terminal screws; obtaining electric current from the one or more socket terminal screws through said metal tabs; and, powering a signal booster with the electric current. The method further comprises the step of providing a conductive material, wherein the conductive material transfers electric current from the terminal screws to the signal booster. In yet another method of improving a wall socket plate with a self-powered signal booster comprising the step of: providing metal tabs on a socket plate for connecting to one or more socket terminals screws; connecting the metal tabs to the socket terminals screws; obtaining electric current from the one or more socket terminals screws through the metal tabs; providing conductive material to transfer electric current to a fluidly connected signal booster, wherein the signal booster is automatically powered when the plate is screwed into the wall socket. In accordance with this embodiment the signal booster is powered by electric current obtained through conductive material touching metal tabs in the wall socket plate.

The installation requirements of the wall socket plate in accordance with the present invention are very simple and easy to use for a consumer. Nonetheless the applicant suggests the following simple procedure:

a) Unscrewing an existing socket plate, b) Aligning the metal tabs about the socket terminal screws, and c) Screwing the wall socket plate to the wall socket.

In accordance with the steps described, the direct contact the metal tabs with the socket terminal screws results in the electric current being transferred to a additional receptacles in the wall socket plate as shown and described herein. In yet other embodiments the electric current passing through the socket terminal screws may be conducted from other side tabs, metal plates or other variations of the embodiments described herein that would be obvious to one of ordinary skill in the art.

In addition, across the world there are many different types of sockets and socket plates available in the market. The embodiments of the present invention can be easily altered to accommodate any wall socket, including but not limited to type A, B, C, D, E, F, G, H, I, J, K, L, M electrical outlets, as each socket and receptacle varies in blade, pin, plug, power, and grounding mechanism, connecting and adding receptacles to the wall socket plate through power conducted through socket terminals is a unique finding in accordance with the present invention that can be easily implemented in any socket, socket box, or socket plate.

The applicant has given a non-limiting description of the devices, methods and systems of the present invention. Many changes may be made to this design without deviating from the spirit of this invention. Examples of such contemplated variations include, but are not limited to the following:

a) The shape and size, thickness and material used for the wall socket plate or parts thereof may be modified.

b) The color, aesthetics and materials may be enhanced or varied, including a feature package of designs or stickers developed to decorate the wall socket plates with at least a third receptacle described.

c) Additional complimentary and complementary functions and features may be added.

d) A more economical version and/or size of the wall socket plate may be adapted.

e) The wall socket plate may be operated manually with a switch or controlled or powered by a different energy, movement, light or other force.

f) The size and location of the signal booster may vary.

Other changes such as aesthetics and substitution of newer materials remain within the spirit of the invention disclosed herein.

While this invention has been described with reference to illustrative embodiments, the embodiments are not intended to be construed in a limiting sense. Various modifications and combinations of the illustrative embodiments as well as other embodiments of the invention will be apparent to a person of ordinary skill in the art upon reference to this description. It is therefore contemplated that the appended claim(s) cover any such modifications and embodiments that fall within the true scope of the invention.

The invenyion claimed is:

1. An improved wall socket plate comprising:

a plate formed to surround one or more receptacles on a wall socket;

one or more tabs connected to said plate, wherein said one or more tabs are designed to touch one or more socket terminal screws when said plate is screwed into a wall socket, wherein said one or more tabs conduct electric current from said one or more socket terminal screws;

a signal booster, wherein the signal booster is connected to said one or more tabs by a conductive material and wherein the signal booster is automatically powered when said plate is screwed into a wall socket; and, a circuit board in said plate.

2. The improved wall socket plate in accordance with claim 1 wherein said one or more tabs are metal tabs.

3. The improved wall socket plate in accordance with claim 1 further including a light in said plate, wherein said light is connected to said one or more tabs by a conductive material and wherein said light is automatically turned on when said plate is screwed into a wall socket.

4. A method for powering a signal booster fluidly coupled to a wall socket plate, comprising:

providing metal tabs on a socket plate for connecting to one or more socket terminal screws;

connecting said metal tabs to said socket terminal screws;

obtaining electric current from said one or more socket terminal screws through said metal tabs; and, powering a signal booster with said electric current.

5. The method in accordance with claim 4 further comprising the step of providing a conductive material, wherein said conductive material transfers electric current from said terminal screws to said signal booster.

6. An improved wall socket plate comprising:

a plate formed to surround one or more receptacles on a wall socket;

one or more tabs connected to said plate, wherein said one or more tabs are designed to touch one or more socket terminal screws when said plate is screwed into a wall socket, wherein said one or more tabs conduct electric current from said one or more socket terminal screws;

a signal booster fluidly coupled to said plate, wherein said signal booster is connected to said one or more tabs by conductive material and wherein said signal booster is automatically turned on when said plate is screwed into a wall socket;

a capacitor, wherein said capacitor is connected to said conductive material; and, a resistor, wherein said capacitor and said resistor reduces electric current from said conductive material from high power to low power to power said signal booster.

7. A method for improving a wall socket plate with a self-powered signal booster comprising:

providing metal tabs on a socket plate for connecting to one or more socket terminals screws;

connecting said metal tabs to said socket terminals screws;

obtaining electric current from said one or more socket terminals screws through said metal tabs; and, providing conductive material to transfer said electric current to a fluidly connected signal booster, wherein said signal booster is automatically powered when said plate is screwed into the wall socket.

8. The method in accordance with claim 7 including the step of powering said signal booster on said wall socket plate with said electric current through said conductive material.

* * * * *